US007614721B2

(12) United States Patent
Ito et al.

(10) Patent No.: US 7,614,721 B2
(45) Date of Patent: Nov. 10, 2009

(54) WIPER DEVICE OF LIQUID EJECTION APPARATUS

(75) Inventors: Hiroyuki Ito, Nagano-ken (JP); Masaru Takahashi, Nagano-ken (JP); Shuhei Harada, Nagano-ken (JP); Seiji Tojo, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 378 days.

(21) Appl. No.: 11/092,986

(22) Filed: Mar. 30, 2005

(65) Prior Publication Data

US 2005/0225593 A1 Oct. 13, 2005

(30) Foreign Application Priority Data

Mar. 30, 2004 (JP) ..... 2004-100834
Feb. 25, 2005 (JP) ..... 2005-051855

(51) Int. Cl.
*B41J 2/165* (2006.01)

(52) U.S. Cl. ..... 347/33

(58) Field of Classification Search ..... 347/22, 347/29–33

See application file for complete search history.

(56) References Cited

U.S. PATENT DOCUMENTS

| | | | | |
|---|---|---|---|---|
| 5,914,734 | A | 6/1999 | Rotering et al. | |
| 6,145,953 | A * | 11/2000 | Medin | 347/28 |
| 6,189,999 | B1 * | 2/2001 | Pham et al. | 347/33 |
| 6,375,302 | B1 * | 4/2002 | Medin | 347/28 |
| 6,409,304 | B1 * | 6/2002 | Taylor | 347/29 |
| 6,592,201 | B2 * | 7/2003 | Sharma et al. | 347/28 |
| 6,637,857 | B2 * | 10/2003 | Shimizu et al. | 347/32 |
| 6,739,696 | B2 * | 5/2004 | Arai et al. | 347/33 |
| 6,913,338 | B2 * | 7/2005 | Rhoads et al. | 347/28 |
| 2001/0012030 | A1 * | 8/2001 | Midorikawa | 347/33 |
| 2001/0020963 | A1 * | 9/2001 | Fukushima et al. | 347/33 |
| 2002/0063748 | A1 * | 5/2002 | Takahashi et al. | 347/33 |
| 2003/0007031 | A1 * | 1/2003 | Sugiyama | 347/33 |
| 2004/0130588 | A1 * | 7/2004 | Nakagawa et al. | 347/33 |
| 2005/0052489 | A1 * | 3/2005 | Kim et al. | 347/29 |

FOREIGN PATENT DOCUMENTS

| | | | |
|---|---|---|---|
| JP | 59209876 | | 11/1984 |
| JP | 59209876 | A | 11/1984 |
| JP | 62251145 | | 10/1987 |
| JP | 62251145 | A | 10/1987 |
| JP | 6-126969 | A | 5/1994 |
| JP | 2001-105612 | A | 4/2001 |

* cited by examiner

*Primary Examiner*—Julian D Huffman
*Assistant Examiner*—Jason S Uhlenhake
(74) *Attorney, Agent, or Firm*—Sughrue Mion, PLLC

(57) ABSTRACT

A wiper device includes a wiper member, a wiper cleaner, and an ink absorbing material. The wiper member wipes a nozzle opening surface of a recording head of a printer. The wiper cleaner always contacts the portion of the wiper member other than the distal end of the wiper member. The wiper cleaner scrapes off the ink adhered to the wiper member and absorbs the ink. The wiper cleaner guides the absorbed ink to the ink absorbing material. The ink absorbing material has an ink absorbability higher than that of an absorption body of the wiper cleaner. The wiper cleaner is thus prevented from becoming saturated with the ink.

19 Claims, 6 Drawing Sheets

WIPER DEVICE OF LIQUID EJECTION APPARATUS

BACKGROUND OF THE INVENTION

The present invention relates to wiper devices of liquid ejection apparatuses.

An inkjet type recording apparatus (hereinafter referred to as a printer), or a liquid ejection apparatus, includes a recording head serving as a liquid ejection head in which a plurality of nozzles are formed. Each of the nozzles ejects ink drops through an opening. When ejected, the ink may adhere to the vicinity of the nozzle opening. Further, for example, if the ink is splashed by a recording medium such as a paper sheet, the ink may adhere to the nozzle opening surface of the recording head. The adhered ink may clog the nozzles or cause offset ejection of ink drops. The printer is thus provided with a wiper mechanism for cleaning the nozzle opening surface of the recording head. The mechanism includes a plate-like wiper member formed of elastomer or the like and a wiper cleaner. The wiper member slides along the nozzle opening surface as deformed flexibly and removes the ink adhered to the nozzle openings and the vicinity thereof (wiping operation). The wiper cleaner is moved relative with the wiper member for wiping off foreign matter collected on the wiper member due to the wiping operation, including the ink (cleaning operation).

As the cleaning operation by the wiper mechanism is repeatedly performed, foreign matter including the ink collects on the wiper cleaner, thus impairing functioning of the wiper member. Further, the collected foreign matter may contaminate the wiper member.

To solve this problem, a wiper device described in Japanese Laid-Open Patent Publication No. 2001-105612 has a wiper member including a rib portion and an extended portion. The rib portion is formed in a surface of the wiper member contacting the wiper cleaner. The extended portion is formed at a lower end of the wiper member. The rib portion limits the contact area between the wiper member and the wiper cleaner when the wiper member and the wiper cleaner are brought into contact. The extended portion limits the gathering area for the collected foreign matter removed from the wiper member.

However, in this wiper device, the ink gathered in the gathering area simply remains in that state unless the ink falls from the wiper cleaner. Also, since the gathering area is relatively small, the gathered ink may easily saturate the area. This impairs functioning of the wiper cleaner.

SUMMARY OF THE INVENTION

Accordingly, it is an objective of the present invention to provide a wiper device of a liquid ejection apparatus that prevents a wiper cleaner from being saturated with liquid.

To achieve the foregoing and other objectives and in accordance with the purpose of the present invention, the invention provides a wiper device of a liquid ejection apparatus that includes a liquid ejection head. The liquid ejection head has a nozzle opening surface in which a nozzle defines an opening for ejecting a liquid. The wiper device includes a wiper member, a cleaner, and an absorbing member. The wiper member wipes the nozzle opening surface for removing the liquid adhered to the nozzle opening surface. The cleaner contacts the wiper member in a slidable manner. The cleaner scrapes off the liquid adhered to the wiper member and guides the liquid downward. The absorbing member is arranged below the cleaner such that the absorbing member contacts the cleaner. The absorbing member absorbs the liquid guided by the cleaner.

The present invention also provides a wiper device of a liquid ejection apparatus that includes a liquid ejection head. The liquid ejection head has a nozzle opening surface in which a nozzle defines an opening for ejecting a liquid. The wiper device includes a wiper member and a cleaner. The wiper member wipes the nozzle opening surface for removing the liquid adhered to the nozzle opening surface. The cleaner contacts the wiper member in a slidable manner. The cleaner scrapes off the liquid adhered to the wiper member and guides the liquid downward. The cleaner has a distal sliding portion that always contacts the wiper member.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

A wiper device according to a first embodiment of the present invention will now be described with reference to FIGS. 1 to 5.

Figure 1:
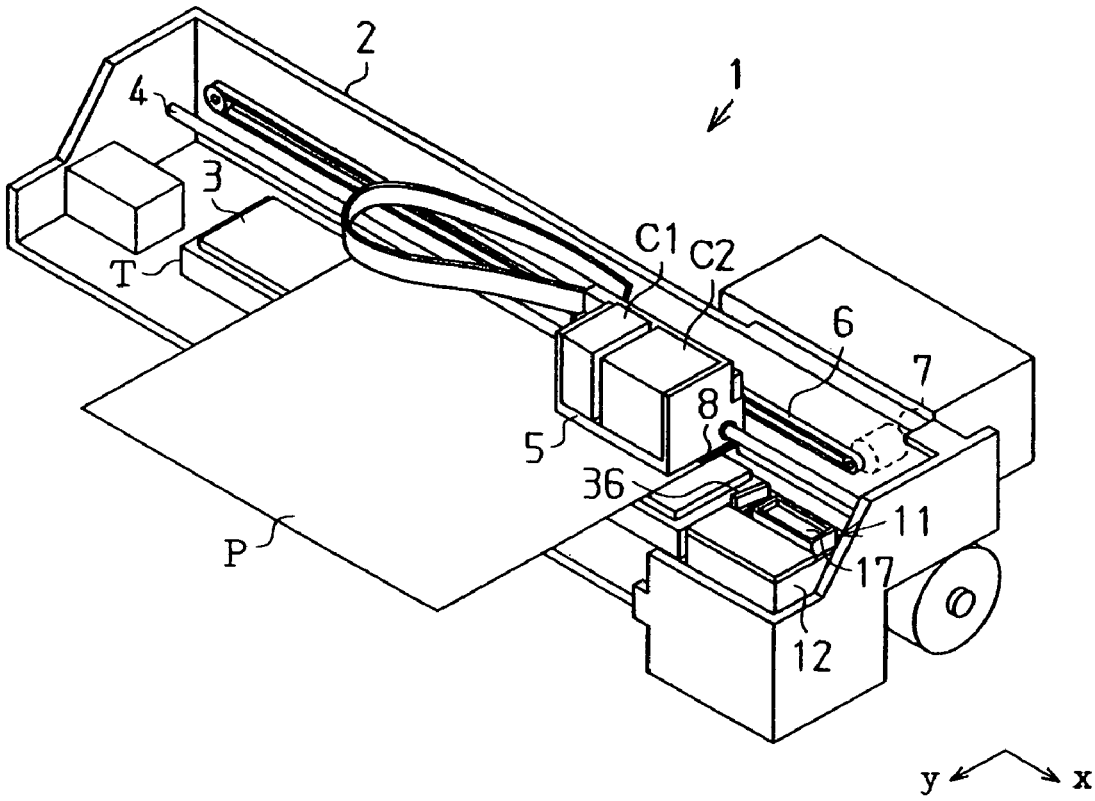
FIG. 1 is a perspective view showing a printer according to a first embodiment of the present invention.

As shown in FIG. 1, a printer 1, or a liquid ejection apparatus, includes a substantially rectangular parallelepiped frame 2 having an upper opening. A platen 3 is provided in the frame 2 and a non-illustrated paper feeder mechanism feeds a paper sheet P, a recording medium, along the platen 3. A waste reservoir T is formed below the platen 3 for retaining waste ink, or used liquid.

The frame 2 further includes a guide member 4 arranged parallel with the platen 3. The guide member 4 is passed through a carriage 5 such that the carriage 5 is supported by the guide member 4 in a movable manner in the axial direction of the guide member 4. The carriage 5 is operably connected to a carriage motor 7 through a timing belt 6. When the carriage motor 7 is actuated, the carriage 5 is reciprocated along the guide member 4.

A first ink cartridge C1 and a second ink cartridge C2 are installed in the carriage 5. The first ink cartridge C1 retains black ink and the second ink cartridge C2 retains different color inks. The first and second ink cartridges C1, C2 are attached to the carriage 5 in a detachable manner.

A recording head 8 serving as a liquid ejection head is formed in a surface of the carriage 5 facing the platen 3. Openings of nozzle lines (not shown), or nozzles, are defined in a lower surface of the recording head 8. Each of the nozzle lines corresponds to an associated one of the color inks. When a piezoelectric element (not shown) is activated, ink drops are ejected to the paper sheet P. Further, a maintenance unit 11 is provided in a non-printing zone defined in the frame 2. When the recording head 8 is not ejecting ink for printing, the maintenance unit 11 cleans the recording head 8 for preventing a printing problem from occurring.

Figure 2:
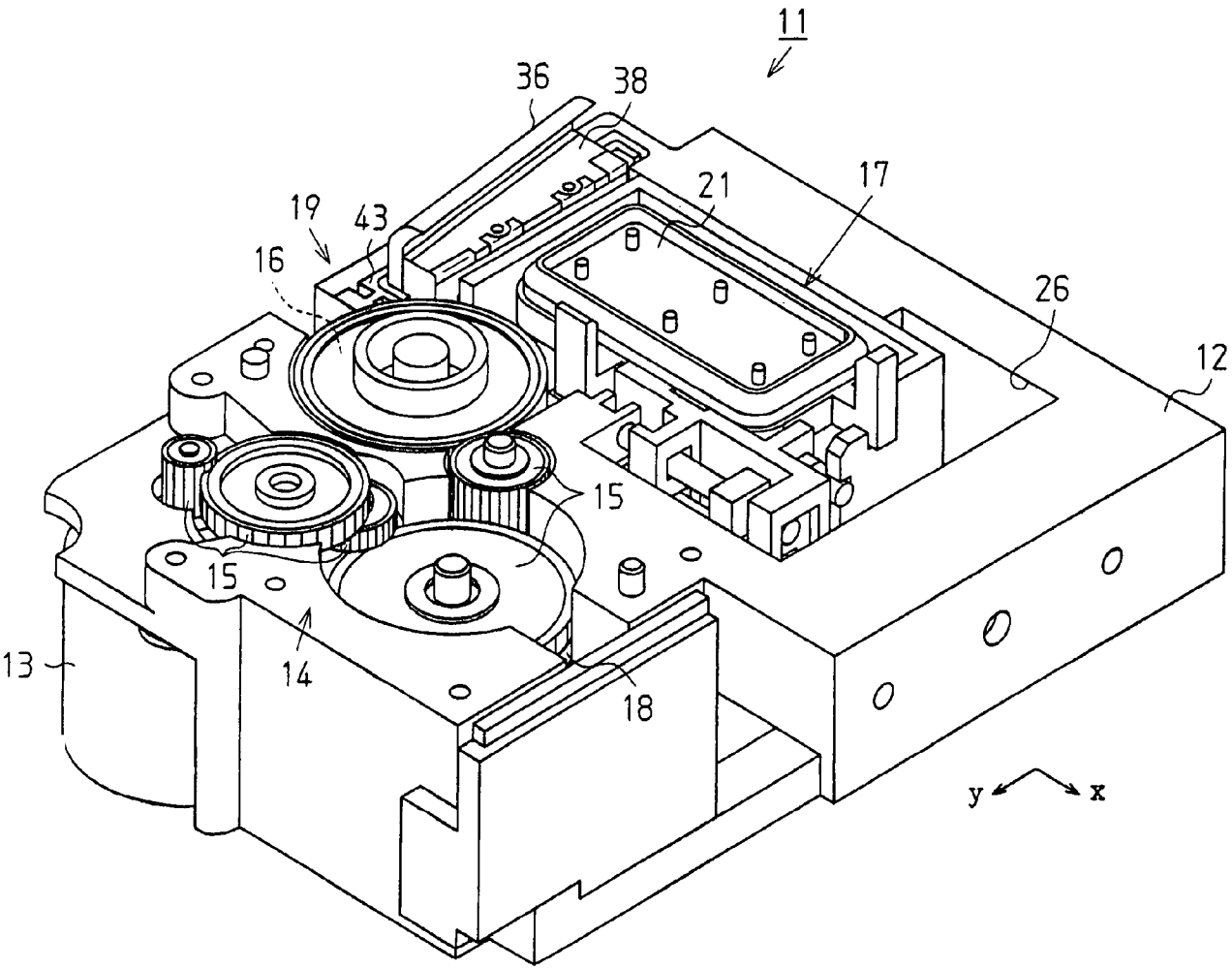
FIG. 2 is a perspective view showing a maintenance unit of the printer of FIG. 1.
Figure 3:
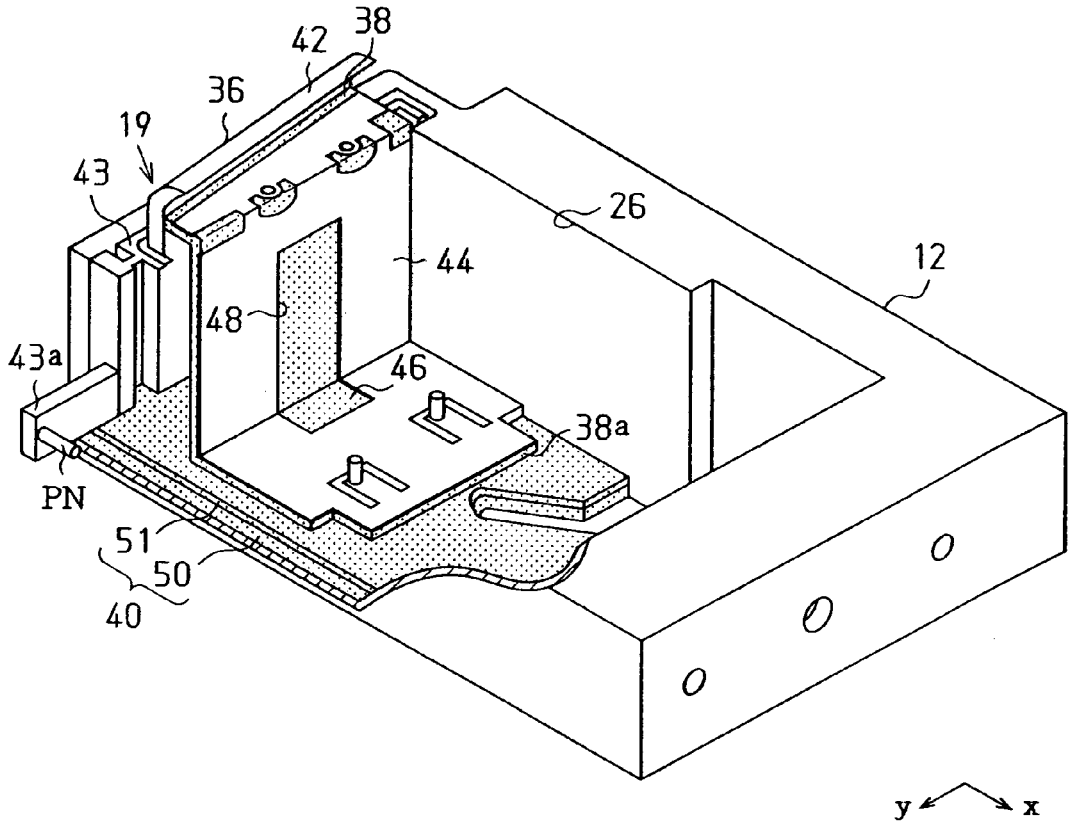
FIG. 3 is a perspective view showing a main portion of the maintenance unit of FIG. 2.
Figure 4:
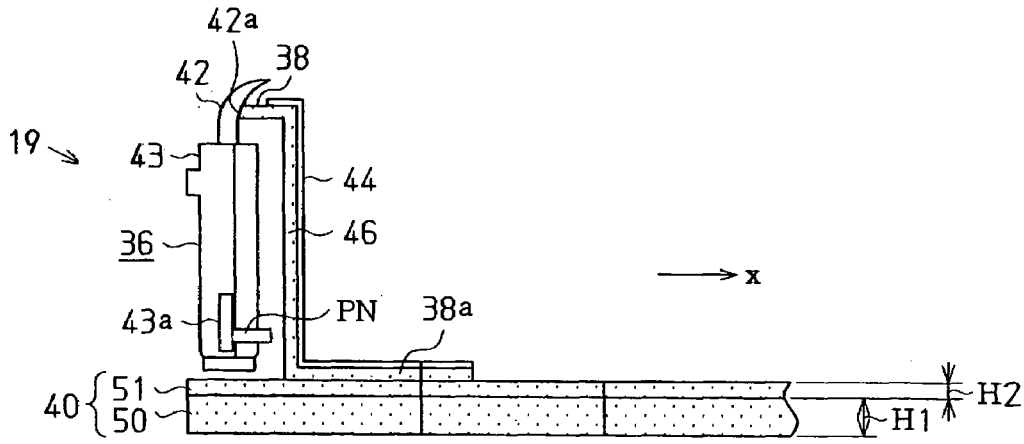
FIG. 4 is a side view showing a wiper device at an initial position.
Figure 5:
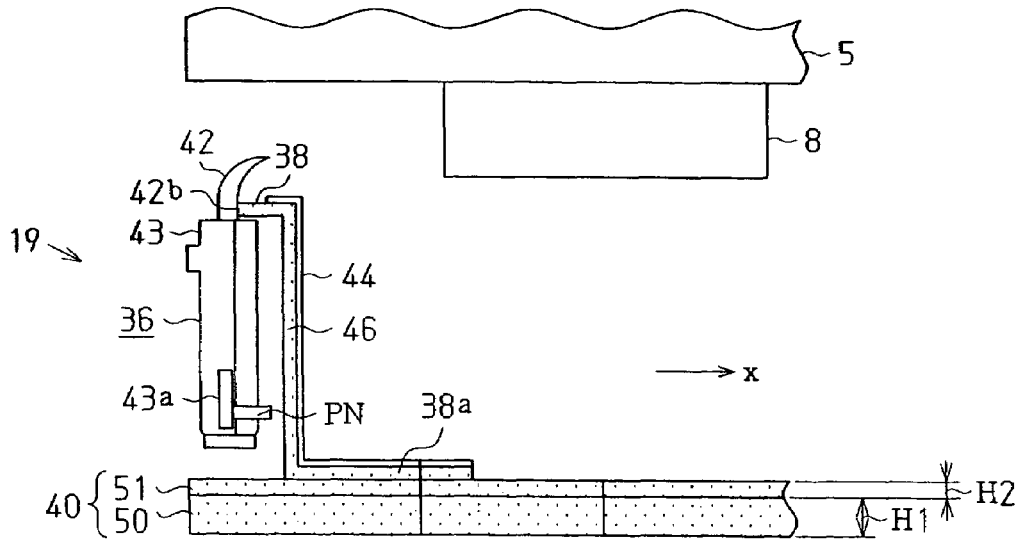
FIG. 5 is a side view showing the wiper device after cleaning.

The maintenance unit 11 will be explained in detail referring to FIGS. 2 to 5. FIG. 2 is a perspective view showing the maintenance unit 11 as a whole, FIG. 3 is a perspective view showing a main portion of the maintenance unit 11, and FIGS. 4 and 5 are side views showing a main portion of the maintenance unit 11. FIG. 2 shows only a main structure of the maintenance unit 11, from which a lid section has been removed.

As shown in FIG. 2, the maintenance unit 11 includes a casing 12 accommodating a drive motor 13 and a transmission mechanism 14. The drive motor 13 is capable of reversing the rotational direction. The transmission mechanism 14 has a gear mechanism 15, which is operably connected to the drive motor 13, and a cylindrical cam 16. In this manner, the drive force of the drive motor 13 is transmitted to a capping device 17 received in the casing 12, a suction pump 18, and a wiper device 19.

A capping device 17 includes a lift mechanism (not shown) and is accommodated in an accommodating portion 26. The lift mechanism is operated through actuation of the transmission mechanism 14 for selectively lifting or lowering a cap 21. The cap 21 is formed in a non-lidded box-like shape. When moved to an upper position (a sealing position) by the lift mechanism, the cap 21 seals a nozzle opening surface of the recording head 8, which is located above the maintenance unit 11. A communication tube (not shown) is connected to a bottom surface of the cap 21. An end of the communication tube is connected to the suction pump 18. The suction pump 18 is formed by a tube pump. The tube of the suction pump 18 is connected to the communication tube, which is connected to the cap 21.

The capping device 17 and the suction pump 18 forcibly discharge the ink from the nozzles of the recording head 8, or, in other words, perform so-called suction cleaning. When the suction cleaning is performed, the suction pump 18 is driven such that fluid such as air or ink is discharged from the tube of the suction pump 18, with the nozzle opening surface of the recording head 8 held in a state sealed by the cap 21. In this manner, negative pressure is produced in a gradually increasing manner in the cap 21, which seals the recording head 8. The negative pressure draws the ink and bubbles retained in the nozzles of the recording head 8, as well as the ink and dust adhered to the nozzle opening surface, into the cap 21. The suction cleaning thus prevents clogging of the nozzles and ink ejection problems from occurring. The ink recovered in the cap 21 is sent to the waste reservoir T (see FIG. 1) through the communication tube and the tube of the suction pump 18.

As shown in FIGS. 3 and 4, the wiper device 19 includes a wiper member 36, a wiper cleaner 38 serving as a cleaner, and an ink absorbing material 40 serving as an absorbing member. The ink absorbing material 40 is accommodated in the accommodating portion 26 and arranged along the bottom surface of the casing 12.

The wiper member 36 is formed of flexible material such as elastomer and includes a wiping portion 42 and a support portion 43. The wiping portion 42 is formed by bending an upper portion of the wiper member 36 in a hook-like shape along a direction indicated by arrow X, or direction X. The support portion 43 supports the wiping portion 42 and selectively raises or lowers the wiping portion 42.

An arm portion 43*a* is formed at a lower section of a side surface of the support portion 43. A pin PN projects from the arm portion 43*a*. By sliding along a cam groove (not shown) of the cylindrical cam 16, the pin PN selectively raises or lowers the support portion 43, or the wiping member 36 (the wiping portion 42). In the first embodiment, when the carriage 5 is moved in an opposite direction of direction X for moving the recording head 8 to a printing zone after cleaning is completed, the support portion 43 (the wiping portion 42) is shifted from an initial position of FIG. 4 to an upper position (a wiping position) of FIG. 5, such that the wiping portion 42 slides along the nozzle opening surface of the recording head 8. In this state, the distal end of the hook-like wiping portion 42 is faced in an opposite direction of the direction in which the carriage 5 moves. Accordingly, the wiping portion 42 wipes off the ink and dust adhered to the nozzle opening surface, and the ink flows downward along the wiping portion 42.

Referring to FIG. 3, the wiper cleaner 38 is formed in a crank-like extended manner and arranged at a position close to arrow X with respect to the wiper member 36. The wiper cleaner 38 is formed by securing, for example, an absorption body 46 formed of polyvinyl alcohol (PVA) sponge to a side surface of a securing plate 44, which serves as a metal support member. That is, the absorption body 46 is supported by and secured to the securing plate 44. A cutaway portion 48 is defined in the securing plate 44 such that the absorption body 46 is exposed from the cutaway portion 48.

As shown in FIGS. 4 and 5, the wiper cleaner 38 has a base portion 38*a* fixed to the ink absorbing material 40. The distal end of the wiper cleaner 38 is bent in the opposite direction of direction X. The securing plate 44 of the wiper cleaner 38 is opposed to the wiper member 36 at a predetermined interval. A distal sliding portion of the absorption body 46 of the wiper cleaner 38 projects from the securing plate 44 and always contacts a side surface of the wiper member 36 (the wiping portion 42) closer to the arrow X.

More specifically, when printing is performed and the carriage 5 is located in the printing zone, the support portion 43 (the wiping portion 42) is maintained at the initial position of FIG. 4. In this state, the absorption body 46 contacts a bent portion 42*a* of the wiping portion 42. When the support portion 43 (the wiping portion 42) is raised to the upper position (the wiping position) of FIG. 5, or when the recording head 8 is moved to the printing zone by the carriage 5 moving in the opposite direction of direction X after cleaning is completed, the absorption body 46 contacts a basal portion 42*b* of the wiping portion 42.

Accordingly, when moving upward or downward, the wiping portion 42 slides along the absorption body 46 of the wiper cleaner 38. The ink wiped off by the wiping portion 42 is thus absorbed by and temporarily retained in the wiper cleaner 38 (the absorption body 46). Further, the ink splashed by the wiping portion 42 in operation is absorbed by and temporarily retained in the absorption body 46 exposed from the cutaway portion 48 (the wiper cleaner 38). The ink retained in the wiper cleaner 38 proceeds along the wiper cleaner 38 (the absorption body 46) and is eventually absorbed by the ink absorbing material 40.

As shown in FIG. 3, the ink absorbing material 40 is arranged along the bottom of the accommodating portion 26 and includes a first layer 50 and a second layer 51, each of which is shaped like a sheet. The first layer 50 is formed of a material having a relatively high ink absorption rate, such as pulp fiber. That is, the ink absorption rate of the first layer 50 is higher than that of the absorption body 46. The second layer 51 is formed on an upper surface of the first layer 50. The second layer 51 is formed of a material producing a relatively small amount of fleece, such as non-woven fabric and a polyvinyl alcohol (PVA) sponge. Referring to FIGS. 4 and 5, the thickness H1 of the first layer 50 is larger than the thickness H2 of the second layer 51, such that a relatively large amount of ink can be retained.

Next, the operation of the maintenance unit 11 will be described. For conducting the suction cleaning, the recording head 8 is moved by the carriage 5 to a position above the maintenance unit 11. When the recording head 8 reaches this position, the cap 21 is operated to seal the nozzle opening surface of the recording head 8 in a manner following the movement of the carriage 5. Further, when the drive motor 13 is driven to rotate the suction pump 18, the ink is discharged from the nozzles of the recording head 8 into the space defined by the cap 21. Meanwhile, the ink in the suction pump 18 is sent to the waste reservoir T.

When the suction cleaning is completed, the lift mechanism lowers the cap 21 to a lower position such that the cap 21 is spaced from the recording head 8. The carriage 5 is moved toward the non-printing zone (in the opposite direction of direction X). In this state, the support portion 43 of the wiper member 36 is located at the upper position of FIG. 5, thus allowing the wiping portion 42 of the wiper member 36 to slide along the nozzle opening surface of the recording head 8, which moves from the position corresponding to the maintenance unit 11 to the printing zone. Since the absorption body 46 contacts the basal portion 42*b* of the wiping portion 42 in this state, the ink wiped off by the wiping portion 42 proceeds along the absorption body 46 and is absorbed by the ink absorbing material 40. As has been described, the ink absorption rate of the ink absorbing material 40 is higher than that of the absorption body 46 of the wiper cleaner 38. Accordingly, the ink absorbed by the absorption body 46 is guided to the ink absorbing material 40 and positively absorbed by the ink absorbing material 40.

Further, when the wiping portion 42 of the wiper member 36 is located at the initial position of FIG. 4, the distal sliding portion of the absorption body 46 contacts the bent portion 42*a* of the wiping portion 42. This structure enables the absorption body 46 to absorb the ink splashed by the wiping portion 42 of the wiper member 36 when operating. Also, even if cleaning by the wiper cleaner 38 is insufficient and the remaining ink falls from the wiper member 36, the ink is absorbed by the absorption body 46.

Although the distal sliding portion of the wiper cleaner 38 (the absorption body 46) slides along the wiping portion 42 from the basal portion 42*b* to the bent portion 42*a*, the distal sliding portion of the wiper cleaner 38 does not contact the distal end of the wiping portion 42. This prevents the absorption body 46 of the wiper cleaner 38 from damaging the distal end of the wiping portion 42, thus prolonging the life of the wiping portion 42 (the wiper member 36).

The first embodiment has the following advantages.

(1) In the first embodiment, the ink removed by the wiper cleaner 38 is introduced into the ink absorbing material 40 through the absorption body 46, which is provided in the wiper cleaner 38. The wiper cleaner 38 is thus prevented from being saturated with the ink removed from the wiper member 36 (the wiping portion 42). In this manner, cleaning function of the wiper cleaner 38 is maintained.

(2) In the first embodiment, the ink absorbability of the ink absorbing material 40, which is arranged below the wiper member 36, is higher than that of the absorption body 46 of the wiper cleaner 38. The ink absorbed by the wiper cleaner 38 (the absorption body 46) is thus allowed to be positively absorbed by the ink absorbing material 40 without being gathered in the wiper cleaner 38. Accordingly, the wiper cleaner 38 is prevented from being saturated, such that functioning of the wiper cleaner 38 is maintained.

(3) In the first embodiment, the distal sliding portion of the wiper cleaner 38 (the absorption body 46) always contacts the wiper member 36 (the wiping portion 42). Therefore, the wiper cleaner 38 always absorbs not only the ink adhered to the wiper member 36 but also, for example, the ink splashed by the wiper member 36 when wiping the nozzle opening surface of the recording head 8. The ink absorbed by the wiper cleaner 38 is introduced into the ink absorbing material 40. Further, even if some ink remains in the wiper member 36 after the cleaning by the wiper cleaner 38 is completed, the wiper cleaner 38 is allowed to absorb and retain the remaining ink falling from the wiper member 36.

(4) In the first embodiment, the distal sliding portion of the wiper cleaner 38 (the absorption body 40) slides along the wiping portion 42 from the basal portion 42*b* to the bent portion 42*a* without contacting the distal end of the wiper member 36 (the wiping portion 42). The wiper cleaner 38 is thus prevented from damaging the distal end of the wiper member 36, so that the life of the wiper member 36 is prolonged.

(5) In the first embodiment, the wiper cleaner 38 is formed in an extended manner such that the wiper cleaner 38 is fixed to the ink absorbing material 40. Accordingly, as compared to, for example, the case in which the wiper cleaner 38 is formed separately from a component for introducing the ink from the wiper cleaner 38 into the ink absorbing material 40, the size of the wiper device 19 is reduced.

(6) In the first embodiment, the absorption body 46 is supported by and secured to the securing plate 44 such that the wiper cleaner 38 contacts the wiper member 36. The contact between the absorption body 46 (the wiper cleaner 38) and the wiper member 36 is thus maintained.

(7) In the first embodiment, the absorption body 46 is supported by and secured to the securing plate 44 in which the cutaway portion 48 is defined. The absorption body 46 exposed from the cutaway portion 48 absorbs the ink splashed by the wiper member 36 (the wiping portion 42) when wiping the nozzle opening surface of the recording head 8. The ink is thus prevented from contaminating the vicinity of the wiper device 19.

A second embodiment of the present invention will hereafter be described with reference to FIGS. 6 to 8. The same or like reference numerals are given to components of the second embodiment that are the same or like the corresponding components of the first embodiment. Explanation of these components will be omitted or simplified.

Figure 6:
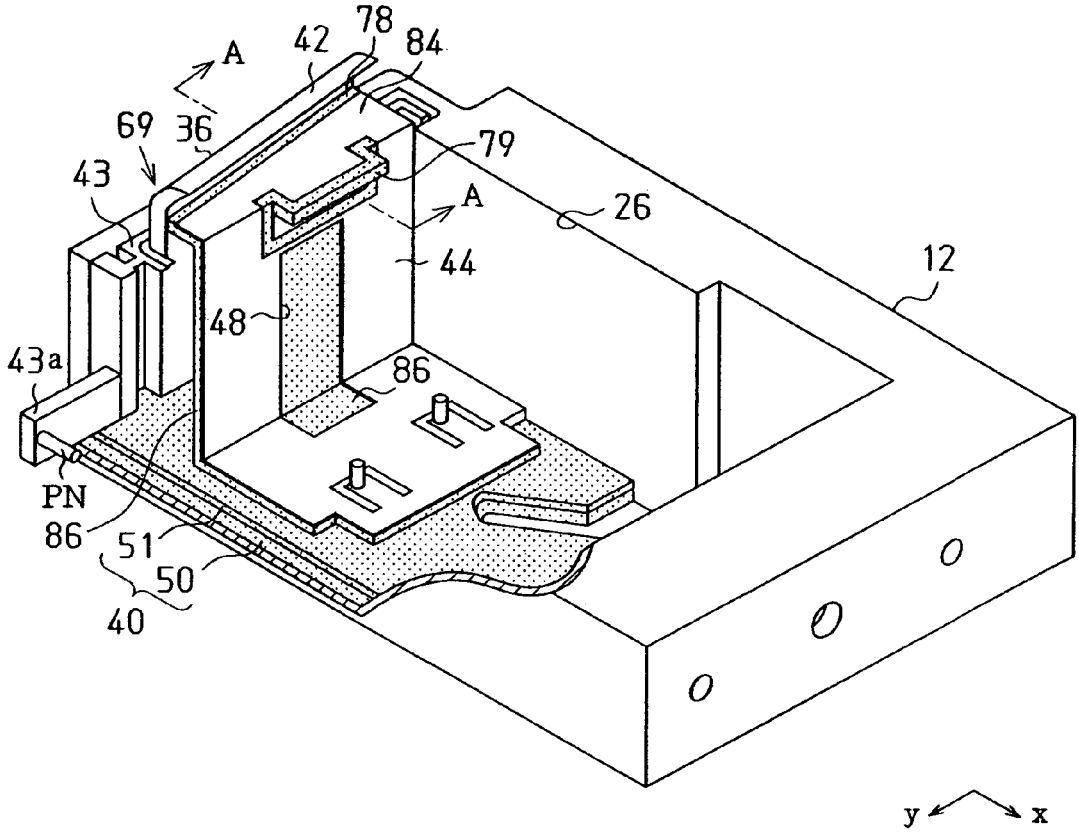
FIG. 6 is a perspective view showing a main portion of a maintenance unit according to a second embodiment of the present invention.

FIG. 6 is a perspective view showing a wiper device 69 according to the second embodiment. The wiper device 69 includes a wiper member 36, a wiper cleaner 78 serving as a cleaner, and the ink absorbing material 40 serving as an absorbing member. The wiper cleaner 78 is formed in a crank-like extended manner such that an end of the wiper cleaner 78 contacts a side surface of the wiper member 36. A portion of the wiper cleaner 78 projects in direction X for forming a cap cleaner 79. An absorption body 86 includes the wiper cleaner 78 and the cap cleaner 79 and is secured to a side surface of a securing plate 84, which is a metal support member.

Figure 7:
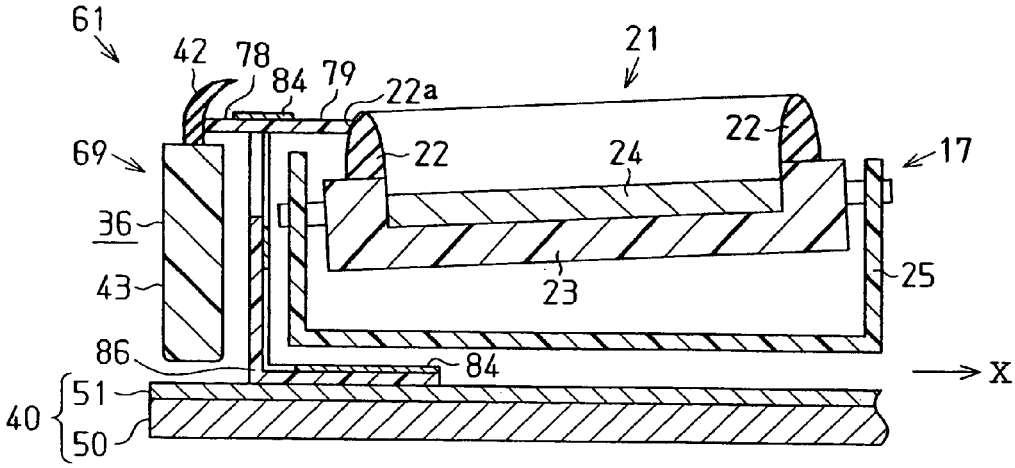
FIG. 7 is a cross-sectional view showing the maintenance unit of FIG. 6 at an initial position.
Figure 8:
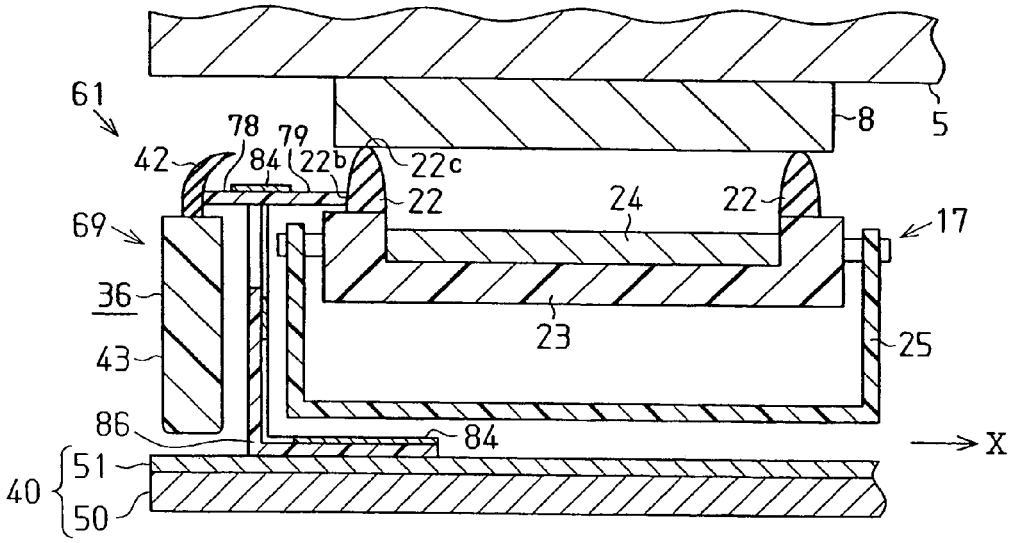
FIG. 8 is a cross-sectional view showing the maintenance unit of FIG. 6 when suction cleaning is performed.

FIGS. 7 and 8 are cross-sectional views showing a maintenance unit 61 taken along line A-A of FIG. 6. The maintenance unit 61 includes the wiper deice 69 and the capping device 17. The capping device 17 is accommodated in the accommodating portion 26 and includes the cap 21, a cap support member 25 connected to the cap 21, and a lift mechanism (not shown). The cap 21 includes a contact member 22, a holder 23 for holding the contact member 23, and an absorbing material 24 provided in the holder 23. The contact member 22 of the cap 21 contacts the nozzle opening surface of the recording head 8 when the suction cleaning is performed. The contact member 22 is formed of, for example, flexible synthetic resin having anti-ink properties, such as rubber.

The cap 21 is actuated by the lift mechanism (not shown) and moved in a vertical direction between an upper position (a sealing position) of FIG. 8 at which the cap 21 seals the nozzle opening surface of the recording head 8 for the suction cleaning and an initial position of FIG. 7 at which the cap 21 is retracted downward from the recording head 8. The rising or lowering amount of the cap 21 is set to a value substantially equal to the rising or lowering amount of the wiper member 36.

When the cap 21 does not seal the nozzle opening surface of the recording head 8, the cap 21 is arranged in a slanted manner as shown in FIG. 7. The cap 21 is thus separated from the recording head 8 from an end of the contact member 22, when being lowered from the contact position after the suction cleaning is completed. This reduces the drive force of the lift mechanism required for separating the cap 21 from the recording head 8. The slanted arrangement of the cap 21 also prevents formation of an ink film between the contact member 22 and the recording head 8, which may be ruptured and splash the ink to the recording head 8.

The distal end of the cap cleaner 79 is extended toward the cap 21. The securing plate 84 is opposed to the wiper member 36 as spaced at a predetermined interval. A distal sliding portion of the absorption body 86 projects from the securing plate 84 and always contacts an outer side surface of the contact member 22. More specifically, when printing is performed and the carriage 5 is located in the printing zone, the cap 21 is located at the initial position of FIG. 7. In this state, the distal end of the cap cleaner 79 contacts an outer distal side surface 22*a* of the contact member 22. When the suction cleaning is performed and the carriage 5 is located above the maintenance unit 61, the cap 21 is located at the upper position (sealing position) of FIG. 8. In this state, the distal end of the cap cleaner 79 contacts an outer basal portion 22*b* of the contact member 22.

Accordingly, when the cap 21 is raised or lowered, the contact member 22 slides along the cap cleaner 79. The cap cleaner 79 is thus allowed to absorb the ink splashed or escaped to the outer side of the cap 21 after the suction cleaning is completed. The ink absorbed by the cap cleaner 79 proceeds along the absorption body 86 and is absorbed by the ink absorbing material 40.

The operation of the maintenance unit 61 will hereafter be explained. For performing the suction cleaning, the recording head 8 is moved to a position above the maintenance unit 61 and the cap 21 is moved by the lift mechanism to the upper position for sealing the nozzle opening surface of the recording head 8. The suction pump 18 is then activated for performing the suction cleaning. When the suction cleaning is completed, the lift mechanism lowers the cap 21 to the lower position and separates the cap 21 from the recording head 8. In this state, the distal end of the cap cleaner 79 always contacts the outer side of the contact member 22. The ink splashed or escaped to the outer side of the cap 21 after the suction cleaning is absorbed by the cap cleaner 79.

Subsequently, the support portion 43 of the wiper member 36 is moved to the upper position and the carriage 5 is moved in the opposite direction of direction X. The wiping portion 42 of the wiper member 36 thus slides along the nozzle opening surface of the recording head 8, thus wiping off the ink adhered to the nozzle opening surface. Like the first embodiment, the ink wiped off by the wiper member 36 is absorbed by the wiper cleaner 78 and proceeds along the absorption body 86. The ink is eventually absorbed by the ink absorbing material 40. At this stage, the ink splashed by the wiper member 36 may be adhered to the outer side of the contact member 22 or the cap cleaner 79. In these cases, the ink adhered to the outer side of the contact member 22 is absorbed by the cap cleaner 79 and the ink splashed directly to the cap cleaner 79 is absorbed by the cap cleaner 79. The ink then proceeds along the absorption body 86 and is introduced into the ink absorbing material 40.

Further, when the cap 21 is located at the initial position, the cap 21 is slanted as shown in FIG. 7. Thus, if the ink is adhered to the outer side of the contact member 22, the ink moves toward the cap cleaner 79 and is gathered in the vicinity of the basal portion 22*b* of the contact member 22. In this case, the next time the cap 21 is raised and lowered for the suction cleaning, the ink is absorbed by the cap cleaner 79 from the vicinity of the basal portion 22*b*. That is, although the cap cleaner 79 is provided only at one side of the cap 21, the cap cleaner 79 is allowed to absorb the ink adhered to the entire circumference of the outer side of the cap 21.

Although the distal sliding portion of the cap cleaner 79 (the absorption body 86) slides along the outer side of the contact member 22 from the basal portion 22*b* to the distal side surface 22*a*, the cap cleaner 79 does not contact a distal end 22*c* of the contact member 22 at which the contact member 22 contacts the recording head 8 and seals the nozzle opening surface. The absorption body 86 of the cap cleaner 79 is thus prevented from damaging the distal end 22*c* of the contact member 22. In this manner, the sealing function of the contact member 22 for the nozzle opening surface is maintained.

The second embodiment has the following advantages in addition to the advantages (1) to (7) of the first embodiment.

(8) In the second embodiment, a portion of the wiper cleaner 78 is extended to form the cap cleaner 79. The wiper device 69 thus becomes relatively small, as compared to the case in which the wiper cleaner 78 and the cap cleaner 79 are formed as separate components.

(9) In the second embodiment, the absorption body 86 including the wiper cleaner 78 and the cap cleaner 79 is provided between the wiper member 36 and the cap 21. This arrangement makes it possible to arrange the wiper member 36 and the cap 21 with respect to the absorption body 86 efficiently. The size of the maintenance unit 61 is thus reduced.

(10) In the second embodiment, the cap 21 is arranged in a slanted manner such that the side of the cap 21 corresponding to the cap cleaner 79 is located downward, when the cap 21 does not seal the nozzle opening surface of the recording head 8. The ink adhered to the outer side of the contact member 22 of the cap 21 thus flows to the side corresponding to the cap cleaner 79. Accordingly, by providing the cap cleaner 79 at a single side of the cap 21, the ink adhered to the entire circumference of the outer side of the contact member 22 can be removed.

(11) In the second embodiment, the rising or lifting amount of the cap 21 is substantially equal to that of the wiper member 36. In other words, the distance by which the wiper cleaner 78 slides along the side surface of the wiper member 36 is substantially equal to the distance by which the cap cleaner 79 slides along the outer side of the contact member 22 of the cap 21. Thus, the wiper cleaner 78 always contacts the wiper member 36, and the cap cleaner 79 always contacts the outer side of the contact member 22. Accordingly, the ink splashed or adhered to the outer side of the contact member 22 of the cap 21 is efficiently removed.

(12) In the second embodiment, the cap cleaner 37 equally absorbs the ink splashed by the wiper member 36 in operation, which is adhered to the outer side of the contact member 22 of the cap 21 or the cap cleaner 79. Therefore, not only the ink adhered or splashed in the suction cleaning but also the ink splashed in the operation of the wiper member 36 is removed.

(13) In the second embodiment, the distal sliding portion of the cap cleaner 79 slides along the outer side of the contact member 22 from the basal portion 22*b* to the distal side surface 22*a* without contacting the distal end 22*c* at which the contact member 22 contacts the recording head 8 for sealing the nozzle opening surface. The absorption body 86 of the cap cleaner 79 is thus prevented from damaging the distal end 22*c* of the contact member 22. Accordingly, the sealing function of the contact member 22 for the nozzle opening surface is maintained.

(14) In the second embodiment, the absorption body 86 is supported by and secured to the securing plate 84 such that the cap cleaner 79 contacts the outer side of the contact member 22 of the cap 21. The contact between the cap cleaner 79 and the contact member 22 is thus reliably maintained.

The illustrated embodiments may be modified as follows.

In the first and second embodiments, the absorption body 46 (the wiper cleaner 38) is formed in an extended manner such that the absorption body 46 (the wiper cleaner 38) is secured to the ink absorbing material 40. However, separately from the wiper cleaner 38, a component may be provided for introducing the ink from the absorption body 46 (the wiper cleaner 38) to the ink absorbing material 40.

In the first and second embodiments, the ink absorbing material 40 is formed by the two layers, the first and second layers 50, 51. However, the ink absorbing material 40 may be configured by a single layer or three or more layers.

In the first and second embodiments, the ink absorption rate of the ink absorbing material 40 is higher than that of the absorption body 46. However, the ink absorbing material 40 may have an ink absorption rate equal to that of the absorption body 46.

Although the securing plate 44 of the first and second embodiments includes the cutaway portion 48, the cutaway portion 48 may be omitted.

Although the cap cleaner 79 and the wiper cleaner 78 of the second embodiment are formed by the common absorption body 86, the cap cleaner 79 and the wiper cleaner 78 may be formed by separate components.

In the second embodiment, the cap cleaner 79 always contacts the contact member 22 of the cap 21. However, instead of the constant contact, the cap cleaner 79 may be brought into contact with the contact member 22 at a certain position along the movement direction of the cap 21 when the cap 21 is raised or lowered. For example, if the cap 21 is moved by a relatively large amount, it may be necessary to space the cap cleaner 79 from the contact member 22 for preventing the cap cleaner 79 from interfering with a different component other than the contact member 22.

Although the cap cleaner 79 of the second embodiment is deployed at a single side of the cap 21, the cap cleaner 79 may be provided at each of the four corners of the cap 21. Alternatively, the single cap cleaner 79 may be formed such that the cap cleaner 79 encompasses the cap 21.

Although the rising or lowering amount of the cap 21 is substantially equal to that of the wiper member 36 in the second embodiment, such amount may differ from that of the wiper member 36.

In the second embodiment, the cap 21 is arranged in a slanted manner when the cap 21 does not seal the nozzle opening surface of the recording head 8. However, the cap 21 may be arranged parallel with the nozzle opening surface.

Regarding the first and second embodiments, a printer ejecting ink (a printing apparatus including a fax and a copier) has been discussed as the liquid ejection apparatus. However, the present invention may be applied to liquid ejection apparatuses ejecting different types of liquid. For example, the present invention may be applied to a liquid ejection apparatus ejecting liquid such as electrode material and color material used in the manufacture of liquid crystal displays, EL displays, and surface emitting displays, or a liquid ejection apparatus ejecting biological organic matter used in the manufacture of biochips, or a sample ejection apparatus serving as a precision pipet. Also, the fluid (the liquid) is not restricted to the ink and may be a different type of fluid (liquid).

The present examples and embodiments are to be considered as illustrative and not restrictive and the invention is not to be limited to the details given herein, but may be modified within the scope and equivalence of the appended claims.

The invention claimed is:

1. A wiper device of a liquid ejection apparatus, the liquid ejection apparatus including a liquid ejection head, the liquid ejection head having a nozzle opening surface in which a nozzle defines an opening for ejecting a liquid, the wiper device comprising:

a wiper member that wipes the nozzle opening surface for removing the liquid adhered to the nozzle opening surface, the wiper member having a distal end capable of contacting the nozzle opening surface for wiping the nozzle opening surface;

a cleaner having a distal sliding portion that contacts the wiper member in a slidable manner, the distal sliding portion scraping off the liquid adhered to the wiper member and the cleaner guiding the liquid downward, the distal sliding portion always remaining in direct contact with a portion of the wiper member other than the distal end, which portion of the wiper member never contacts the nozzle opening surface; and an absorbing member arranged below the cleaner such that the absorbing member contacts the cleaner, the absorbing member absorbing the liquid guided by the cleaner.

2. The device according to claim 1, wherein the cleaner is formed of a material capable of absorbing the liquid, and wherein the absorbing member has a liquid absorbability higher than that of the cleaner.

3. The device according to claim 1, wherein the wiper member is movable between a wiping position at which the wiper member is allowed to wipe the nozzle opening surface and a position retreated from the wiping position.

4. The device according to claim 3, wherein the liquid ejection apparatus includes a cap movable between a sealing position at which the cap seals the nozzle opening surface and a position retreated from the sealing position, and wherein the cleaner is arranged such that at least part of the cleaner is allowed to contact the cap.

5. The device according to claim 4, wherein the cleaner is arranged between the wiper member and the cap.

6. The device according to claim 4, wherein the liquid ejection head is movable along a direction intersecting a direction in which the wiper member is moved, and wherein the wiper member and the cap are arranged along the moving direction of the liquid ejection head with the cleaner located between the wiper member and the cap.

7. The device according to claim 4, wherein, when the cap does not seal the nozzle opening surface, the cap is slanted such that a portion of the cap corresponding to the cleaner is located lower than an opposed portion of the cap.

8. The device according to claim 1, wherein the cleaner includes an absorption body capable of absorbing the liquid and a support member for supporting the absorption body.

9. The device according to claim 8, wherein the support member is formed in a plate-like shape and has a cutaway portion for exposing the absorption body, such that the liquid is allowed to be absorbed by the absorption body through the cutaway portion.

10. The device according to claim 1, wherein the portion of the wiper member, with which the distal sliding portion remains in direct contact, comprises a fixed portion on the wiper member.

11. The device according to claim 1, wherein the wiper member is not a rotational member.

12. A wiper device of a liquid ejection apparatus, the liquid ejection apparatus including a liquid ejection head, the liquid ejection head having a nozzle opening surface in which a nozzle defines an opening for ejecting a liquid, the wiper device comprising:

a wiper member that wipes the nozzle opening surface for removing the liquid adhered to the nozzle opening surface, the wiper member having a distal end capable of contacting the nozzle opening surface for wiping the nozzle opening surface; and a cleaner having a distal sliding portion that contacts the wiper member in a slidable manner, the distal sliding portion scraping off the liquid adhered to the wiper member, the distal sliding portion always remaining in direct contact with a portion of the wiper member other than the distal end, which portion of the wiper member never contacts the nozzle opening surface.

13. The device according to claim 12, wherein the wiper member is movable between a wiping position at which the wiper member is allowed to wipe the nozzle opening surface and a position retreated from the wiping position.

14. The device according to claim 13, wherein the liquid ejection apparatus includes a cap movable between a sealing position at which the cap seals the nozzle opening surface and a position retreated from the sealing position, and wherein the cleaner is arranged such that at least part of the cleaner is allowed to contact the cap.

15. The device according to claim 14, wherein the cleaner is arranged between the wiper member and the cap.

16. The device according to claim 14, wherein the liquid ejection head is movable along a direction intersecting a direction in which the wiper member is moved, and wherein the wiper member and the cap are arranged along the moving direction of the liquid ejection head with the cleaner located between the wiper member and the cap.

17. The device according to claim 14, wherein, when the cap does not seal the nozzle opening surface, the cap is slanted such that a portion of the cap corresponding to the cleaner is located lower than an opposed portion of the cap.

18. The device according to claim 12, wherein the cleaner includes an absorption body capable of absorbing the liquid and a support member for supporting the absorption body.

19. The device according to claim 18, wherein the support member is formed in a plate-like shape and has a cutaway portion for exposing the absorption body, such that the liquid is allowed to be absorbed by the absorption body through the cutaway portion.

* * * * *